US011597630B2

(12) United States Patent
Piper et al.

(10) Patent No.: US 11,597,630 B2
(45) Date of Patent: Mar. 7, 2023

(54) OR RELATING TO STAIRLIFTS

(71) Applicant: Stannah Stairlifts Limited, Hampshire (GB)

(72) Inventors: Martin Thomas Piper, Andover (GB); Paul Alexander Cook, Shrewton (GB); Nigel Titchener, Andover (GB)

(73) Assignee: Stannah Stairlifts Limited, Hampshire (GB)

( * ) Notice: Subject to any disclaimer, the term of this patent is extended or adjusted under 35 U.S.C. 154(b) by 459 days.

(21) Appl. No.: 16/645,279

(22) PCT Filed: Sep. 6, 2018

(86) PCT No.: PCT/GB2018/052524
§ 371 (c)(1),
(2) Date: Mar. 6, 2020

(87) PCT Pub. No.: WO2019/048862
PCT Pub. Date: Mar. 14, 2019

(65) Prior Publication Data

US 2020/0283262 A1 Sep. 10, 2020

(30) Foreign Application Priority Data

Sep. 8, 2017 (GB) ..... 1714523

(51) Int. Cl.

| | |
|---|---|
| ***B66B 1/34*** | (2006.01) |
| ***B66B 1/46*** | (2006.01) |
| ***B66B 5/00*** | (2006.01) |
| ***B66B 9/08*** | (2006.01) |

(52) U.S. Cl.
CPC ..... *B66B 1/3407* (2013.01); *B66B 1/468* (2013.01); *B66B 5/0087* (2013.01); *B66B 9/08* (2013.01); *B66B 2201/46* (2013.01)

(58) Field of Classification Search
CPC ..... B66B 1/3407; B66B 1/468; B66B 5/0087; B66B 9/08; B66B 2201/46; B66B 9/0869
See application file for complete search history.

(56) References Cited

U.S. PATENT DOCUMENTS

| | | | | |
|---|---|---|---|---|
| 2016/0297641 | A1 | 10/2016 | Sonnenmoser | |
| 2020/0165103 | A1 * | 5/2020 | Titchener | B66B 9/08 |

FOREIGN PATENT DOCUMENTS

| | | | |
|---|---|---|---|
| GB | 2463734 | A | 3/2010 |
| WO | 2009/098480 | A1 | 8/2009 |

OTHER PUBLICATIONS

Vincent G Duffy et al: "Handbook of Digital Human Modeling", Apr. 19, 2016; XP055533788, p. 13-p. 15; figures 1, 11, 12.

(Continued)

*Primary Examiner* — Jeffrey Donels
(74) *Attorney, Agent, or Firm* — Dinsmore & Shohl LLP

(57) ABSTRACT

The disclosure defined by this invention relates to an electronic control facility for a stairlift. The control facility includes an installation mode in which a number of steps to be undertaken at the time of installation of the stairlift are defined. The control facility also includes a user mode in which the operation of the stairlift is controlled by a user. According to the invention, the control facility is configured so that the user mode cannot be entered until all steps in the installation mode have been completed.

12 Claims, 1 Drawing Sheet

(56) References Cited

OTHER PUBLICATIONS

International Search Report and Written Opinion dated Jan. 2, 2019; International Application No. PCT/GB2018/052524.
UK Search Report dated Feb. 23, 2018; United Kingdom Application GB1714523.6.

* cited by examiner

OR RELATING TO STAIRLIFTS

CROSS-REFERENCE TO RELATED APPLICATIONS

This application is the U.S. national stage of PCT/GB2018/052524 filed Sep. 6, 2018, which claims priority of United Kingdom Patent Application 1714523.6 filed Sep. 8, 2017 both of which are hereby incorporated by reference in their entirety.

FIELD OF THE INVENTION

This invention relates to stairlifts and, in particular, to apparatus for and/or a method of, ensuring the safety or integrity of a stairlift installation.

BACKGROUND OF THE INVENTION

A stairlift is a safety-critical device widely installed in private homes and used by persons who typically have some form of physical disability and no particular technical training. It is therefore important that a stairlift is installed correctly and is functioning correctly when the technician effecting the installation leaves the installation site. This is all the more so because, unlike some safety-critical devices which require inspection by an independent person prior to being approved for use, the installing technician is also the individual who approves the device for use.

At present the installer will typically work to a check-list which itemises the individual checks that should be made at the time of installation. However, if a particular check is overlooked, there is no indication of this and no prevention against it occurring.

It is an object of the invention to provide apparatus for a stairlift which will go at least some way in addressing the aforementioned problem; or which will at least provide a novel and useful choice.

SUMMARY OF THE INVENTION

Accordingly, in a first aspect, the invention provides an electronic control facility for a stairlift characterised by having an installation mode in which a plurality of defined installation steps may be undertaken, and a user mode wherein a number of defined user steps may be undertaken under the control of a stairlift user, wherein said electronic control facility is configured to prevent entry into said user mode until steps undertaken in said installation mode have been completed.

Preferably said electronic control facility is configured so that said defined installation steps have to be undertaken in a defined order.

Preferably said electronic control facility is configured to give a prompt of a test to be undertaken, and a further prompt that the test has been successfully completed.

Preferably said prompt and said further prompt are visual and/or audible indications.

Preferably said electronic control facility further includes a switch for switching between said installation facility and said user facility.

Preferably said switch is a manually operated switch.

In a second aspect the invention provides a stairlift including the electronic control facility as set forth above.

Preferably said electronic control facility is accessed via a printed circuit board incorporated in the stairlift.

Preferably said printed circuit board is located in a stairlift chair.

Preferably said printed circuit board includes a mode display operable to visually indicate if the electronic control facility is in an installation mode or a user mode, and a test display operable to visually indicate an installation test to be undertaken.

Preferably said printed circuit board further includes a switch operable to switch said electronic control facility between said installation mode and said user mode.

In a third aspect the invention provides a method of controlling the installation of a stairlift, said method being characterised by configuring an electronic control facility incorporated in the stairlift to have an installation mode and a user mode, and further configuring said electronic control facility to prevent entry into said user mode until tests defined in said installation mode have been undertaken.

Many variations in the way the present invention can be performed will present themselves to those skilled in the art. The description which follows is intended as an illustration only of one means of performing the invention and the lack of description of variants or equivalents should not be regarded as limiting. Subject to the scope of the appended claims, wherever possible, a description of a specific element should be deemed to include any and all equivalents thereof whether in existence now or in the future.

BRIEF DESCRIPTION OF THE DRAWINGS

The various aspects of the invention will now be described with reference to the example shown in the accompanying drawings in which.

DETAILED DESCRIPTION OF THE PREFERRED EMBODIMENT

Figure 1:
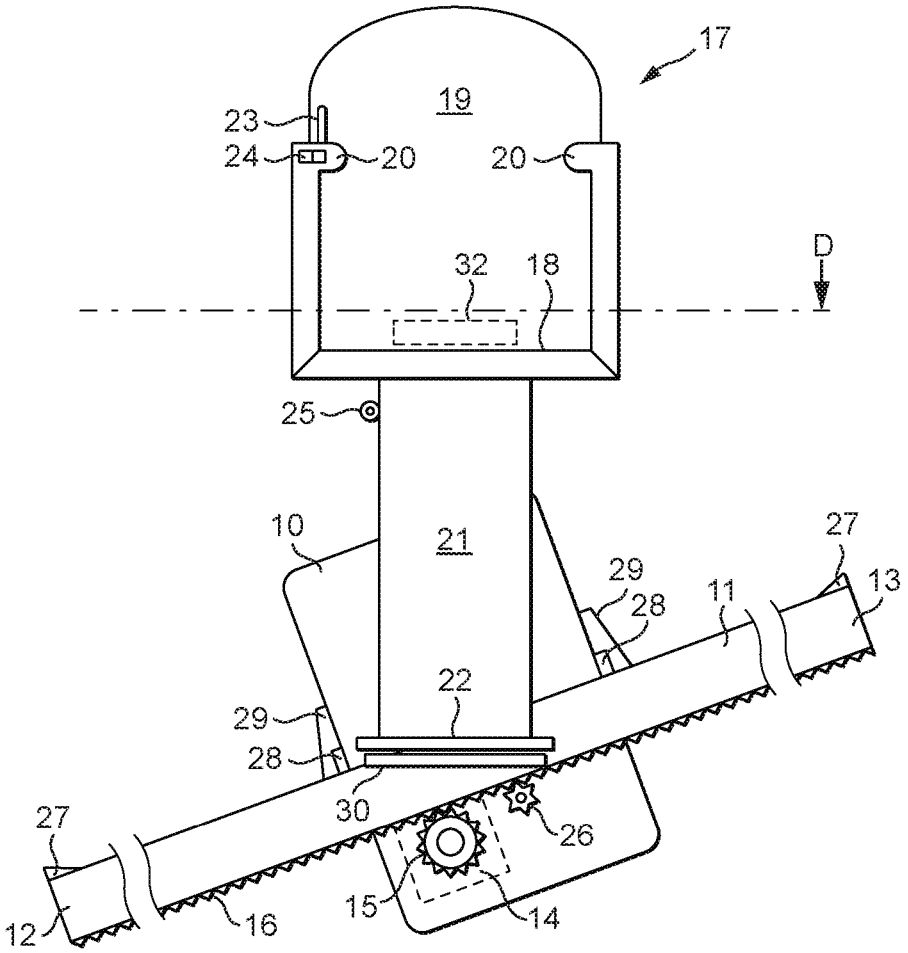
FIG. 1 is a schematic view of a stairlift according to the invention.

This invention provides a means and method of ensuring the correct installation and testing of a stairlift. As shown in FIG. 1, a typical stairlift comprises a carriage 10 mounted on a rail 11 for movement between a lower end 12 and an upper end 13 of the rail. In the form shown a motor 14 mounted in the carriage 10 drives a pinion 15 which engages a rack 16 extending along the underside of the rail, to effect displacement of the carriage along the rail. A chair 17 is mounted on the carriage to provide seating for a stairlift user. The chair includes a seat base 18, a seat back 19 and two armrests 20 and is mounted to the carriage by way of an interface 21. A footrest 22 is mounted on the lower end of the interface.

A hand control such as joystick 23 is mounted on one of the armrests 20 to enable a user to control movement of the carriage along the rail and a bistable switch 24 is also provided to isolate the hand control when the stairlift is not in use. A further key-switch 25 is also typically provided to enable the prevention of unauthorised use of the stairlift.

A further motor (not shown) is provided which, in the known manner, pivots the interface relative to the carriage to maintain the seat base 18 substantially level as the carriage moves through bends in the rail in which the inclination of the rail varies with respect to a horizontal datum indicated by D.

Being a safety critical device, a stairlift must include a number of features to ensure passenger safety when in use.

Thus, an over-speed governor 26 is provided which monitors the speed of the carriage 10 on the rail 11 and triggers a safety gear if the speed exceeds a predetermined maximum. When the over-speed governor triggers the safety gear it also opens a switch (not shown) to cut power to the drive motor 14. Also shown in FIG. 1 are ultimate stops 27 which are contacted by switch pads 28 in the carriage to cut power to the motor 14 when the carriage arrives at and end of the rail; and safety pads 29 which are moveably mounted on the carriage and are displaced in the event the carriage, whilst travelling along the rail, comes into contact with an obstruction. Displacement of either safety pad 29 opens a switch (not shown) to cut power to the drive motor 14. The footrest 22 may include a further safety pad 30 operating an arrangement of switches that cut power to the drive motor 14 in the event an obstruction is encountered which causes the pad 30 to be displaced laterally, but also in the event that the pad 30 comes down vertically on an obstruction. One example of such an arrangement is described in greater detail in our UK Patent No. GB 2 435 463.

At installation the safety features described above must be checked and confirmed as operating correctly before the stairlift is approved for use. The present invention provides a means of ensuring that this, in reality, occurs. According to the invention an electronic control facility is included in the operating circuitry of the stairlift which has at least an installation mode and a user or normal operating mode, the control facility being configured so that access to the user mode, and thus normal operation, is denied until actions in the installation mode have been completed, and confirmed as having been completed.

The main operating electronic control unit (ECU) of the stairlift may be configured with these modes or a separate ECU may be added into the safety system of the stairlift. The ECU configured according to the invention is conveniently accessed by a user interface incorporated in a printed circuit board (PCB) 32 mounted in the chair 17 but this is by no means essential.

Figure 2:
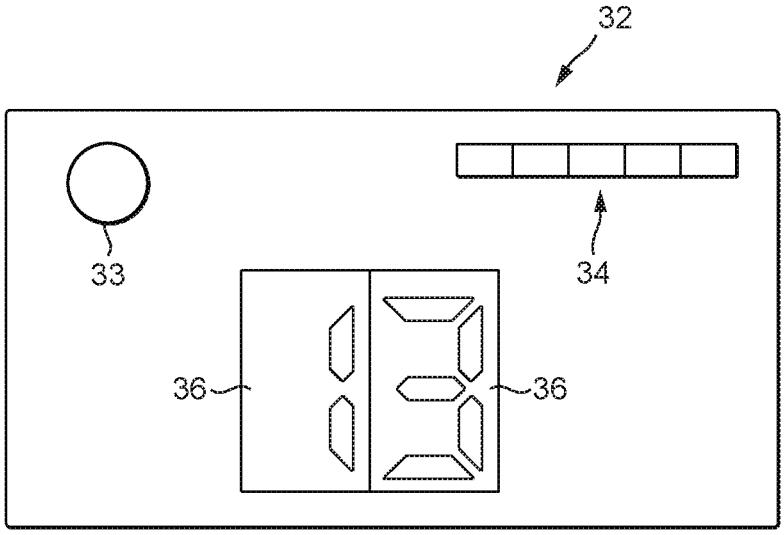
FIG. 2 is a schematic view of a circuit board embodied in the stairlift shown in FIG. 1.

Turning now to FIG. 2, a highly diagrammatic illustration of PCB 32 is shown in the sense that most of the electronic components have been omitted for clarity, leaving only those components that contribute to the performance of the invention. In the form shown the PCB 32 includes a navigation switch, preferably a manually operated switch 33, a series 34 of indicators such as LEDs to indicate a selected mode, and a pair of displays 36, preferably 7-segment displays, the function of which will be described in greater detail below. However those skilled in the art will recognise that mode-switching could be effected electronically by a range of devices and other means, including visual and/or audible, could be used to indicate a selected mode and indicate a test to be performed within a selected mode.

As a first step, in performing an installation, the installer accesses the PCB 32 and uses the switch 33 to select 'Installation' mode. Successful selection of this mode is indicted by flashing of the appropriate LED in the series 34. Having selected Installation mode the installer is then prompted by numbers appearing in the displays 36 to manually undertake the steps necessary to complete installation.

The ECU is preferably configured so that the left-hand display 36 indicates a primary task and the right hand number includes a step within that task. By way of example only, the following primary tasks form part of an installation:

0 Set Seat Level Position (relative to datum D)
1 Test Ultimate Switches
2 Test Left Safety Pads
3 Test Right Safety Switches
4 Map the Rail
5 Set/Delete Stopping/Parking Positions The above numbers are displayed on the left hand display 36. The numbers in the right hand display then indicate the series of steps required to complete each of the above tasks. Again by way of example only, primary task 1 might include the following steps:

1.1 Test Final Limit switches
1.2 Test Over-speed Governor switch
1.3 Test the Level Drive
1.4 Test the Handing Link (that determines if the installation is left-handed or right-handed)
1.5 Test the Bistable switch
1.6 Test the Key switch
1.7 Test the Swivel Centre operation Each task in a sequence will have a step that must be physically undertaken by the installer, and a correct outcome achieved.

In FIG. 2, the display is indicating that the task to be performed is to set or test the level drive. A static display is indicated at the start of the test. When the level drive switch is physically displaced by the installer to perform the test, and the switch is operating correctly, the right hand display 3 will flash and release of the switch will then prompt the right hand display to indicate a static 4 as the prompt for test 1.4. An audible signal may also be used to indicate a successful conclusion of a particular test. Obviously if the '3' does not flash when the level drive switch is displaced, that is an indication that remedial action is required and the ECU is configured so that test 1.4 cannot be undertaken until the fault is corrected and a flashing '3' obtained.

The ECU is configured so that the tests in each task must be performed in the order prescribed and the next test in the sequence is only prompted once a test has been completed and correct operation has been confirmed. Generally, the ECU is configured so that the display 37 automatically moves onto the next step when a test has been completed satisfactorily. Once all of the above tests have been completed in the prescribed order then, and only then, can the User mode be selected by operation of switch 33.

It will thus be appreciated that the present invention, at least in the case of the embodiment described above, provides an effective means of ensuring complete and correct installation of a stairlift which, in turn, enhances the likelihood of user safety.

The invention claimed is:

1. An electronic control facility for a stairlift, the electronic control facility configured to perform:

an installation mode in which, at the time of installation of the stairlift, a plurality of defined installation steps are undertaken, and a user mode in which, following completion of installation, a number of defined user steps are undertaken under the control of a stairlift user;

said electronic control facility being configured to prevent entry into said user mode until steps undertaken in said installation mode have been completed.

2. The electronic control facility as claimed in claim 1, wherein said electronic control facility is configured so that said defined installation steps have to be undertaken in a defined order.

3. The electronic control facility as claimed in claim 1, wherein said electronic control facility is configured to give a prompt of a test to be undertaken, and a further prompt that the test has been successfully completed.

4. The electronic control facility as claimed in claim 3, wherein said prompt and said further prompt are visual indications.

5. The electronic control facility as claimed in claim 1, further comprising a switch for switching between said installation mode and said user mode.

6. The electronic control facility as claimed in claim 5, wherein said switch is a manually operated switch.

7. A stairlift including the electronic control facility as claimed in claim 1.

8. The stairlift as claimed in claim 7, wherein said electronic control facility is accessed via a printed circuit board incorporated in the stairlift.

9. The stairlift as claimed in claim 8, wherein said printed circuit board is located in a stairlift chair.

10. The stairlift as claimed in claim 8, wherein said printed circuit board includes a mode display operable to visually indicate if the electronic control facility is in an installation mode or a user mode, and a test display operable to visually indicate an installation test to be undertaken.

11. The stairlift as claimed in claim 8, wherein said printed circuit board further includes a switch operable to switch said electronic control facility between said installation mode and said user mode.

12. A method of controlling the installation of a stairlift, said method comprising:

configuring an electronic control facility incorporated in the stairlift to have an installation mode in which, at the time of installation of the stairlift a number of defined installation steps are undertaken, and a user mode in which, following the completion of installation, a number of defined operating steps are undertaken under the control of a stairlift user; and configuring said electronic control facility to prevent entry into said user mode until tests defined in said installation mode have been undertaken.

* * * * *